US005095937A

United States Patent [19]

LeBlanc et al.

[11] Patent Number: 5,095,937

[45] Date of Patent: Mar. 17, 1992

[54] TWO STAGE AUTOMATIC SHUT OFF VALVE

[75] Inventors: Leo J. LeBlanc, Bloomfield; Bruce R. Johnson, Muskegon, both of Mich.

[73] Assignee: EBW, Inc., Muskegon, Mich.

[21] Appl. No.: 647,282

[22] Filed: Jan. 29, 1991

Related U.S. Application Data

[63] Continuation-in-part of Ser. No. 534,442, Jun. 6, 1990, Pat. No. 5,010,915.

[51] Int. Cl.[5] ..... F16K 31/22; F16K 33/00

[52] U.S. Cl. ..... 137/423; 137/400; 137/432; 137/448; 137/312; 141/128; 141/198; 251/149.9; 251/212

[58] Field of Search ..... 137/312, 400, 403, 423, 137/432, 445, 448; 141/86, 128, 198, 212, 213, 216; 222/68; 251/89.5, 149.9, 212

[56] References Cited

U.S. PATENT DOCUMENTS

| | | | |
|---|---|---|---|
| 979,819 | 12/1910 | Anderson . | |
| 1,219,222 | 3/1917 | Baxter . | |
| 1,246,033 | 11/1917 | Adams . | |
| 1,262,443 | 4/1918 | Cahill . | |
| 1,268,947 | 6/1918 | Fell . | |
| 1,289,490 | 12/1918 | Lundstrom . | |
| 1,312,531 | 8/1919 | Garbisch . | |
| 1,313,386 | 8/1919 | Jones . | |
| 1,360,869 | 11/1920 | Beliveau . | |
| 1,462,253 | 7/1923 | Tobiasson . | |
| 1,463,129 | 7/1923 | Milton | 141/220 |
| 1,689,066 | 10/1928 | Baxter . | |
| 1,859,009 | 5/1932 | Stetson | 137/423 |
| 1,892,455 | 12/1932 | Ayers . | |
| 1,978,314 | 10/1934 | Lancaster | 229/86 |
| 2,199,085 | 4/1940 | Smith | 137/139 |
| 2,299,360 | 10/1942 | Tharp | 137/104 |
| 2,340,936 | 2/1944 | Cook | 220/86 |
| 2,499,409 | 3/1950 | Norway | 62/1 |
| 2,569,110 | 9/1951 | McGillis | 137/68 |
| 2,578,926 | 12/1951 | Douglas | 226/127 |
| 2,685,891 | 8/1954 | Segelhorst | 137/614.16 |
| 2,705,372 | 4/1955 | Cornell | 33/126.7 |
| 2,773,706 | 12/1956 | Leavell | 284/19 |
| 2,811,179 | 10/1957 | Greenwood | 141/95 |
| 2,918,931 | 12/1959 | Siri | 137/211 |

(List continued on next page.)

FOREIGN PATENT DOCUMENTS

| | | |
|---|---|---|
| 620649 | 6/1929 | France . |
| 1360869 | 12/1964 | France . |
| 1444260 | 7/1976 | France . |
| 2331732 | 6/1977 | France . |
| 2355736 | 1/1978 | France . |
| 1531083 | 11/1978 | France . |

OTHER PUBLICATIONS

Emco-Wheaton Advertisement for the A1100 Guardian, "Petroleum-Marketer", Sep.-Oct., 1990.

OPW Advertisement for OPW 61-50, "Petroleum—Marketer", Sep.-Oct., 1990.

*Primary Examiner*—George L. Walton

*Attorney, Agent, or Firm*—Basile and Hanlon

[57] ABSTRACT

A two stage float actuated shutoff valve for use in underground fuel storage tanks having a co-axial vapor recovery system utilizes a drop tube co-axially mounted within the storage tank fill pipe. Fuel flowing into the tank is passed through the drop tube which projects downwardly into the interior of the tank to a valve housing located at the lower end of the drop tube. Tubular floats slidably mounted on the drop tube within the tank independently operate pivoted flapper valves to a closed position within the valve housing, a lower float closing one valve flapper to block a major portion of the incoming fuel flow passage when the level of fuel in the storage tank reaches a predetermined first level and a second upper float closing a second flapper to completely close the flow passage when the level of fuel rises to a predetermined level about the first level. A float actuated locking arrangement for preventing inadvertent premature closing of either valve flapper is disclosed.

18 Claims, 8 Drawing Sheets

U.S. PATENT DOCUMENTS

| | | | |
|---|---|---|---|
| 2,918,932 | 12/1959 | Few | 137/211 |
| 3,078,867 | 2/1963 | McGillis | 137/416 |
| 3,189,039 | 6/1965 | Bauer | 137/434 |
| 3,347,263 | 10/1967 | Thompson | 137/448 |
| 3,438,316 | 4/1969 | Rodier | 95/64 |
| 3,495,635 | 2/1970 | Yuvinou | 137/433 |
| 3,563,263 | 2/1971 | Benson | 137/202 |
| 3,610,273 | 10/1971 | Russell | 137/513.3 |
| 3,661,175 | 5/1972 | Tillman | 137/517 |
| 3,732,902 | 5/1973 | Muller | 141/198 |
| 3,787,022 | 1/1974 | Wilcox | 251/212 |
| 3,791,407 | 2/1974 | Nicholls | 137/512.15 |
| 3,794,077 | 2/1974 | Fanshier | 137/513.3 |
| 3,799,502 | 3/1974 | Baum | 251/124 |
| 3,895,402 | 7/1975 | Page | 4/172.17 |
| 3,963,041 | 6/1976 | McGillis | 137/410 |
| 4,175,296 | 10/1977 | Goldman | 4/325 |
| 4,266,582 | 5/1981 | Sergent | 141/198 |
| 4,396,034 | 8/1983 | Cherniak | 137/514 |
| 4,407,325 | 10/1983 | Cherniak | 137/514 |
| 4,469,116 | 9/1984 | Hansen | 137/39 |
| 4,630,655 | 12/1986 | Fleischer | 141/198 |
| 4,667,711 | 5/1987 | Draft | 141/198 |
| 4,703,874 | 11/1987 | Tapperman | 222/198 |
| 4,793,387 | 12/1988 | LeBlanc | 141/86 |

TWO STAGE AUTOMATIC SHUT OFF VALVE

REFERENCE TO RELATED APPLICATION

This application is a continuation in part of a commonly owned co-pending patent application Ser. No. 07/534,442, filed June 6, 1990 now U.S. Pat. No. 5,010,915.

BACKGROUND OF THE INVENTION

The present invention is directed to a float actuated shutoff valve employed to prevent overfilling of a liquid storage tank, such as an underground fuel storage tank, for example.

The typical underground fuel storage tank utilized in service stations throughout the United States has a capacity of several thousand gallons and is normally buried beneath the service station apron at a depth below the frost line. A fill pipe extends upwardly from the top of the tank to a supply hose coupling accessible within a relatively shallow manhole. To fill the tank, a supply hose from the tank truck is coupled to the fill pipe, and fuel is fed by gravity from the tank truck through the supply hose and fill pipe into the tank. The head space of the tank is normally provided with an atmospheric vent. In almost all cases, there is no gauge for indicating the state of fullness of the tank. In theory, the fuel delivery man is supposed to measure the amount of fuel in the tank prior to filling by inserting a dip stick through the fill pipe, and is prohibited from connecting the storage tank to a fuel compartment of the tank truck which has more fuel than can be placed in the storage tank without overfilling the storage tank. Unfortunately, this procedure is not always followed, and overfilling of the storage tank and the resultant spillage of fuel is a common occurrence.

As a result of environmental concerns, float actuated valves have been employed in increasing numbers to automatically close off or block the fill pipe when the level of fuel within the storage tank rises to a level indicating the tank is nearly full. The float actuated valves of the prior art typically employ a pivoted flapper valve in which the valve flapper or head is withdrawn into a recess at one side of the fuel inlet passage to the tank during filling and coupled to a float disposed within the tank to be pivoted outwardly into the flow path of the incoming fuel when the level within the storage tank rises to the selected level. The flapper is then driven to its seat with considerable force by the downwardly flowing fuel, resulting in a substantial water hammer effect when the rate of flow of fuel through the supply hose and fill pipe coupling is reduced from a typical rate of 400 gallons per minute to zero almost instantaneously.

In parent application Ser. No. 07/534,442 referred to above, this water hammer effect is minimized by employing a two-stage valve in which a first valve flapper is float actuated when the tank is approximately 90% full to close and partially, but not completely, block the incoming flow passage. With the passage partially blocked by closure of the first flapper, the rate of flow of fuel into the tank is substantially reduced, and the less severe water hammer generated by the partial closure can be observed by the delivery man who can, if he is so motivated, shut off the flow of fuel at the tank truck at a time when the storage tank has ample capacity to receive the 25 or 30 gallons remaining in the tank truck hose downstream of the tank truck shutoff valve. If, through inattention, the driver does not shut off the delivery hose upon closure of the first flapper, the subsequent rise in level of fuel in the tank will, when the tank is approximately 95% full, raise a second float which will close a second flapper which, with the closed first flapper, will completely block flow through the fill pipe. No more fuel will flow into the storage tank, and the driver can close the tank truck shutoff valve at leisure. Fuel trapped in the supply hose between the tank truck shutoff valve and the coupling can be drained into an overfill storage container such as that disclosed in U.S. Pat. No. 4,793,387.

In the two-stage shutoff valve shown in the aforementioned parent application, the flapper valves are mounted within a valve housing at the upper end of a drop tube projecting downwardly through the storage tank fill pipe into the tank. The supply hose coupling to which the tank truck supply hose is coupled during a filling operation is mounted at the top of the drop tube. In certain areas of the country, recently enacted regulations require that vapor expelled from the underground storage tank during a filling operation be returned to the tank truck during the filling operation rather than being vented to atmosphere. The most convenient way of accomplishing this vapor recovery is to employ an arrangement in which fuel is conducted into the storage tank via the drop tube which is loosely received within the storage tank fill pipe, and vapor passing upwardly through the space between the outside of the fuel carrying drop tube and the inside of the fill pipe is passed through the supply coupling to the tank truck hose coupling, from which it is conducted back to the tank truck. This is accomplished by mounting an adapter at the top of the storage tank fill pipe which has an enlarged central passage opening into the interior of the fill pipe and co-axially mounting, within the enlarged central passage of the adapter, the smaller diameter drop tube. The hose coupling on the tank truck hose fits around the outer side of the adapter, and the fuel flow passage through the hose coupling is sealed to the upper end of the drop tube when the hose coupling is mated to the fill pipe supply coupling. Passages through the hose pipe coupling conduct vapor from the fill pipe to a vapor transfer hose. With such an arrangement, it is impractical to mount the two-stage valve of parent application Ser. No. 07/534,442 at the top of the fill pipe, and the present invention is directed to a solution for that problem.

The valve flappers of parent application Ser. No. 07/534,442 are, as is typical with the prior art, mounted for pivotal movement about a horizontal axis, and when in their open position project vertically upwardly from the pivot axis. When in its open position, the flapper is located within a recess in the side of the flow passage so that the main stream of downwardly flowing incoming fuel passes in front of the flapper. Only a slight movement of the flapper from its open position will swing the top edge of the flapper into the main stream of the fuel, and once this occurs, the fuel stream overrides the flapper actuating mechanism and forcibly drives the flapper to its closed position. Because at least some of the incoming fuel will flow into the recess behind the flapper there is at least some possibility that this last flow could shift the flapper forwardly from its open position enough to cause a premature closure of the flapper.

The present invention provides a float actuated locking pin arrangement which will prevent such premature closure.

SUMMARY OF THE INVENTION

The shutoff valve of the present invention is designed to be used in conjunction with either a standard fuel storage tank vented at a location remote from the fuel inlet or with an underground fuel storage tank having a so-called co-axial vapor recovery system utilizing certain portions of the shutoff valve assembly. In a co-axial vapor recovery system, an elongate drop tube is passed freely downwardly through the conventional storage tank fill pipe, and the supply hose coupling at the upper end of the fill pipe and the drop tube define co-axial passages adapted to be connected to a co-axial elbow or tank truck supply hose coupling. Fuel from the tank truck passes downwardly through the interior of the drop tube, while fuel vapor expelled from the storage tank by the incoming fuel passes upwardly through the space between the fill pipe and drop tube into a vapor passage in the elbow connected to a vapor receiving compartment in the tank truck.

In the valve assembly of the present invention, the drop tube constitutes the fuel inlet to a two-stage shutoff valve whose housing is mounted at the lower end of the drop tube to be located within the interior of the storage tank well below the top of the tank. A fuel flow passage extends vertically from the drop tube downwardly through the valve housing and is formed with an upwardly facing valve seat extending around the upper end of a reduced diameter section of the flow passage. A first and a second plate-like valve flapper are located at opposite sides of the passage immediately above the valve seat for pivotal movement between respective open positions where the flappers project upwardly from the valve seat and are located in recesses at opposite sides of the passage out of the main path of flow of fuel downwardly through the valve housing. Each flapper is formed with a crank which is pivotally connected to the lower end of respective actuating rods. The actuating rods project upwardly freely through vertical bores in the housing. The rod from the first flapper is pivotally connected at its upper end to a first or lower hollow tubular float slidably received upon the drop tube above the housing. The actuating rod of the second valve flapper passes upwardly from the housing freely through a vertical bore through the first float and is pivotally secured at its upper end to a second or upper hollow tubular float slidably received upon the drop tube above the first float. When the floats are in their lower or unbuoyed position, both flapper valves are in their open position. During filling of the tank, as the level of fuel rises above the valve housing, the first float becomes buoyed upwardly and upward movement of the first float causes its actuating rod to pivot the first valve flapper from its open position outwardly into the path of downwardly flowing fuel which promptly drives the first flapper to a valve closed position. When in its closed position, the first valve flapper lies across a major portion of the reduced diameter section of the flow passage and, when closed, substantially reduces, but does not completely terminate, the flow of fuel downwardly through the valve. As the level of fuel within the storage tank continues to rise, the second or upper float is buoyed upwardly, and its actuating rod similarly swings the second valve flapper into the path of flow of fuel which drives the second flapper to its valve closed position upon the valve seat. When both flappers are in their closed position, the reduced diameter section of the passage is completely blocked, and no further fuel can flow into the tank.

Closure of both flappers traps a column of fuel within the drop tube above the flappers to hold the flappers in their closed position. As fuel is withdrawn from the tank, the level of fuel within the tank drops, and as the fuel level drops, the level of the column of fuel trapped in the drop tube above the closed valve flappers also drops because that portion of the flow passage above the closed valve flappers is vented into the interior of the storage tank via the bores in the valve housing through which the valve actuating rods project. Thus, the head of fuel holding the flappers in their closed position decreases, and at some point after the fuel no longer buoys up the upper of the two floats, the unbuoyed weight of the upper float will be sufficient to overcome the head of fuel holding the smaller or second valve flapper in its closed position, and open the second valve flapper to drain the trapped fuel from the drop tube into the storage tank. Further dropping of the fuel level within the tank will result in downward movement of the first or lower float, and this downward movement will restore the first valve lapper to its open position.

To prevent an inadvertent or premature closure of the flappers induced by the downward flow of incoming fuel, each flapper is provided with a float actuated locking pin in the form of an elongate vertical rod which passes freely through a vertical bore in the top of the housing and a vertical bore through the float which actuates the flapper A stop collar on the locking rod rests on the top of the float when the float is in its lowered unbuoyed position to locate the lower end of the locking rod in front of the opened flapper to constitute a positive stop preventing movement of the flapper from its open position. Upward movement of the float as it is buoyed up by the rising fuel level in the tank lifts the rod upwardly to move its lower end clear of the flapper just before the float actuates the flapper. A pivoted rod gripper controlled by a stop collar on the associated actuating rod is employed to lock the locking pin in an inoperative position until after the float has been lowered sufficiently to return the flapper to its open position, at which time the gripper releases the locking rod.

Other objects and features of the invention will become apparent by reference to the following specification and to the drawings.

IN THE DRAWINGS

DESCRIPTION OF THE PREFERRED EMBODIMENTS

Figure 1:
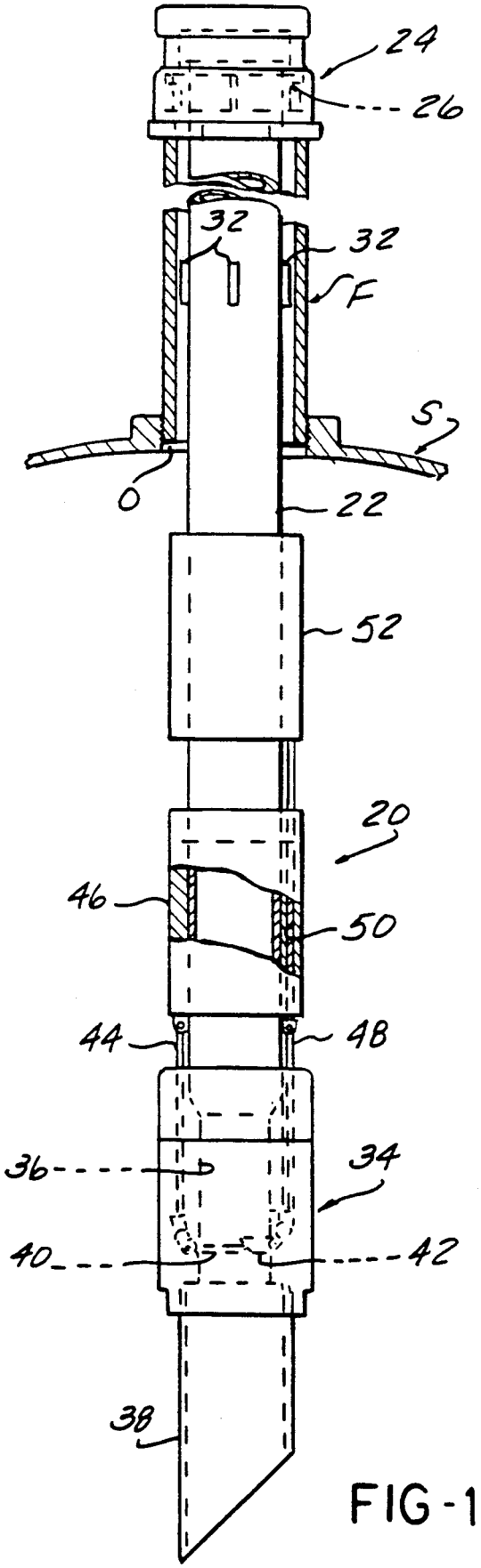
FIG. 1 is a side elevational view of a valve assembly embodying the present invention mounted within a partially indicated storage tank, with certain parts broken away, shown in section, or indicated in broken line.
Figure 7:
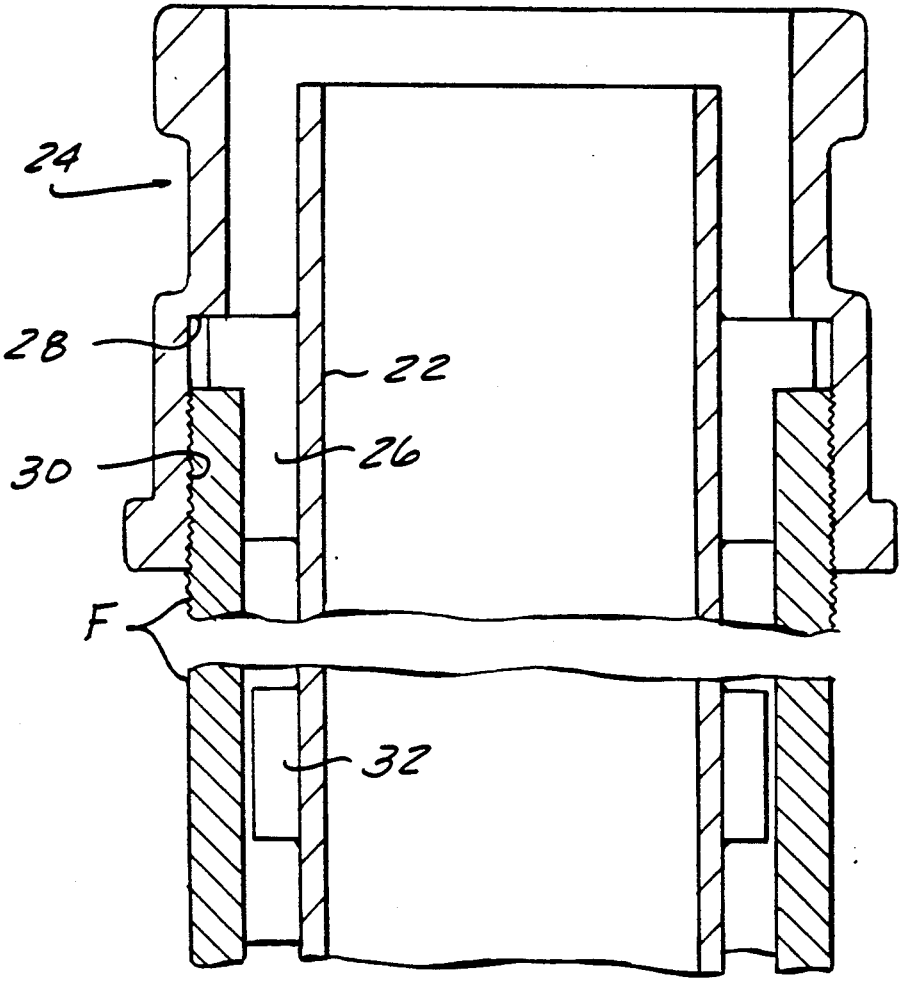
FIG. 7 is a detailed cross sectional view showing details of the mounting of the drop tube of the valve assembly within the fill pipe of an underground storage tank.

Referring first to FIG. 1, a two-stage shutoff valve assembly designated generally 20 is shown mounted within the interior of an underground fuel storage tank partially indicated at S having a fill pipe F extending upwardly from an inlet opening O in the top of tank S. Valve assembly 20 includes an elongate hollow drop tube 22 suspended from its upper end upon the fill pipe. A coupling adapter 24 is threadably received upon the upper end of fill pipe F. Drop tube 22 extends freely downwardly through fill pipe F well into the interior of tank S. Referring briefly to FIG. 7, drop tube 22 is suspended from fill pipe F by means of three or more L shaped retaining tabs 26 welded to the outer side of drop tube 22. The tabs 26 are located and dimensioned to rest upon and within the upper end of the fill pipe as shown in FIG. 7 and are held in position against the top of the fill pipe as by a downwardly facing shoulder 28 on the interior of the coupling adapter 24 which is threadably received as at 30 upon the upper end of the fill pipe. Drop tube 22 is centered in co-axial relationship with fill pipe F as by a plurality of centering tabs 32 dimensioned to engage the inner surface of fill pipe F.

The foregoing arrangement provides co-axial liquid fuel and fuel vapor passages through which liquid fuel can flow downwardly through the interior of drop tube 22 into tank S, while fuel vapor expelled from the head space of tank S by the incoming fuel can pass upwardly through the fill pipe at the exterior of drop tube 22 to be collected by the vapor passage of a conventional co-axial tank truck hose nozzle (not shown) coupled in a well known manner to the upper end of coupling adapter 24.

In older, so-called standard storage tanks employed where fuel vapor expelled from the tank during the filling operation is not recovered by the tank truck by the coaxial recovery system described above, a simple threaded adapter for securing the upper end of the drop tube 22 to the upper end of the fill pipe may be substituted for the tabs 26 and 28.

A two-part valve housing designated generally 34 is fixedly mounted upon the lower end of drop tube 22 and is formed with a flow passage 36 extending vertically through the housing which may open at its lower end into the tank via an extension nozzle 38.

First and second valve flappers 40, 42 are mounted in a manner to be described in greater detail below within housing 34. Valve flapper 40 is coupled by an actuating rod 44 to a first or lower hollow tubular float 46 loosely slidably received on the exterior of drop tube 22 above housing 34. A second actuating rod 48 is coupled at its lower end to the second valve flapper 42 and projects vertically upwardly from housing 34 loosely through a bore 50 through the lower float 46 and is pivotally coupled at its upper end to a second or upper float 52 which, like lower float 46, is of a hollow tubular construction and loosely slidably received upon the exterior of drop tube 22. The valve structure described generally above is shown in more detail in FIGS. 2 and 3.

Figure 2:
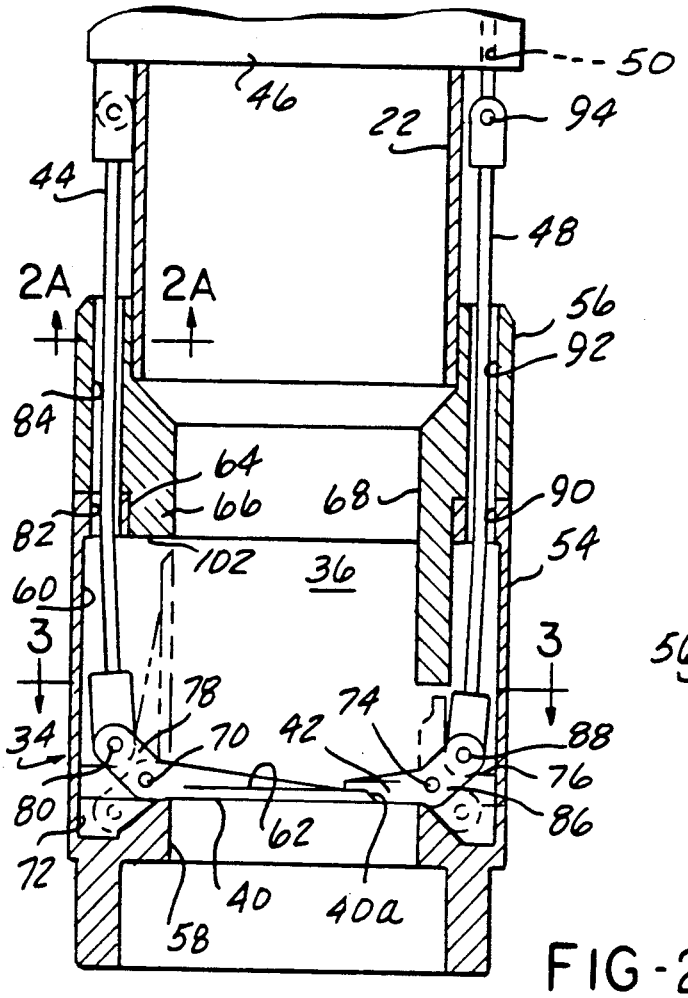
FIG. 2 is a detailed cross sectional view taken on a vertical plane showing a portion of the lower end of the drop tube and valve housing of the valve assembly of FIG. 1.
Figure 2A:
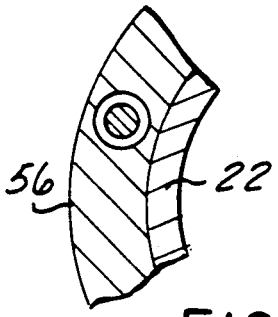
FIG. 2A is a detailed cross sectional view of a portion of the valve housing, taken on line 2A—2A of FIG. 2.
Figure 3:
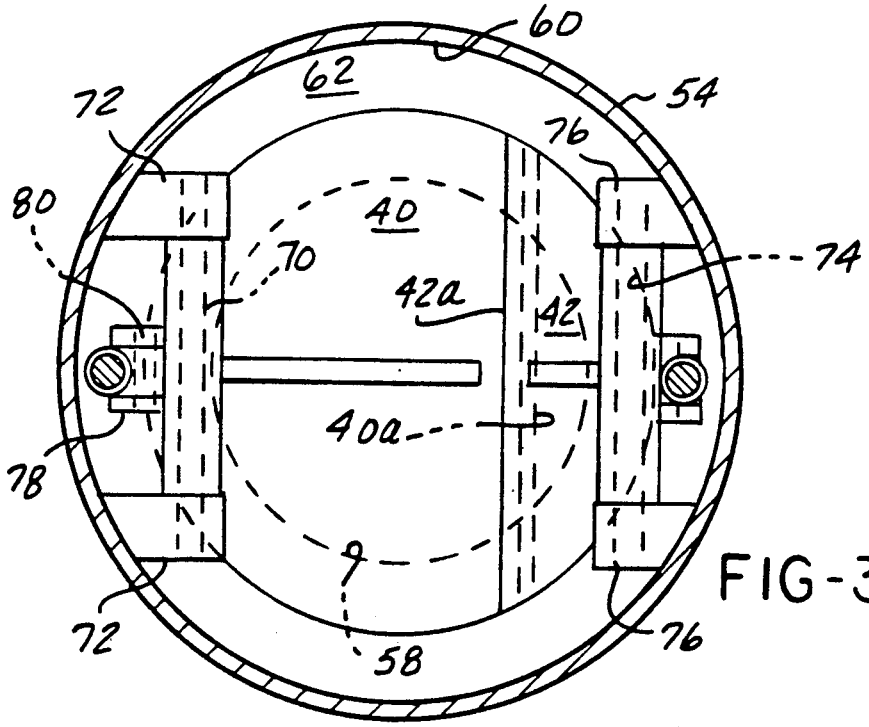
FIG. 3 is a detailed cross sectional view taken on line 3—3 of FIG. 2.

Referring now particularly to FIG. 2, it is seen that housing 34 includes a lower housing member 54 and an upper housing member 56. Flow passage 36 extends downwardly through both of housings 56 and 54, and is formed near the lower end of lower housing 54 with a reduced diameter section 58 which merges at its upper end with a relatively large diameter section 60 of passage 36 via a horizontal upwardly facing shoulder 62 which, in a manner to be described below, functions as a valve seat.

At the upper end of enlarged diameter passage section 60, lower housing 54 is formed with an inwardly projecting annular flange 64 which provides a locating seat for the lower end 66 of upper housing 56. In its extent through upper housing 66, flow passage 36 is constituted by a bore 68 of substantially the same diameter as that of the reduced diameter section 58 of lower housing 54.

Valve flapper 40 is mounted within lower housing 54 for pivotal movement about a horizontal axis established by a pivot pin 70 received at its opposite ends in bosses 72 projecting upwardly from valve seat shoulder 62 at one side of passage 36. When in the closed position shown in FIG. 3 and shown in full line in FIG. 2, the lower surface of valve flapper 40 lies upon the upwardly facing valve seat shoulder 62. The edge 40*a* of valve flapper 40 remote from its pivotal mounting 70 is a straight edge extending parallel to the axis of pin 70 which is so located that flapper 40, when in its closed position, does not entirely overlie the reduced diameter section 58 of flow passage 36.

Valve flapper 42 similarly is pivotally mounted upon lower housing 54 for rotation about a horizontal axis defined by a pivot pin 74 received in bosses 76 formed on valve seat shoulder 62. When in its closed position, the edge 42*a* of valve flapper 42 overlaps the corresponding edge 40*a* of valve flapper 40 so that when both flappers 40 and 42 are in the closed positions shown in FIG. 3, the entire reduced diameter section 58 of flow passage 36 is cooperatively blocked by the two flappers, whose lower surfaces are in sealed face to face engagement with the upwardly facing valve seat shoulder 62.

Valve flapper 40 is formed with an integral crank arm 78 pivotally connected at its distal end to the lower end of actuating rod 44 as by a pivot pin 80. Actuating rod 44 projects upwardly from crank 78 loosely through enlarged bores 82 and 84 respectively formed in the upper flange of lower housing 54 and in upper housing 56. Since the lower end of actuating rod 44 has a horizontal component of movement as crank 78 swings about its fixed pivotal axis defined by pivot pin 70, bores 82 and 84 must be of a large enough diameter to accommodate horizontal shifting movement of rod 44.

Similarly, an integral crank 86 formed on the second valve flapper 42 is pivotally connected as at 88 to the lower end of actuating rod 48 which similarly projects upwardly through enlarged aligned bores 90 and 92 in the respectively lower and upper housings 54, 56. Rod 48 may include a pivotal interconnection 94 between its upper and lower ends so that the bore 50 through lower float 46 through which the upper section of rod 48 passes need not be substantially enlarged since the horizontal play of the lower end portion of rod 48 can be fully accommodated in the enlarged bores 90, 92 of the valve housing.

Figure 4:
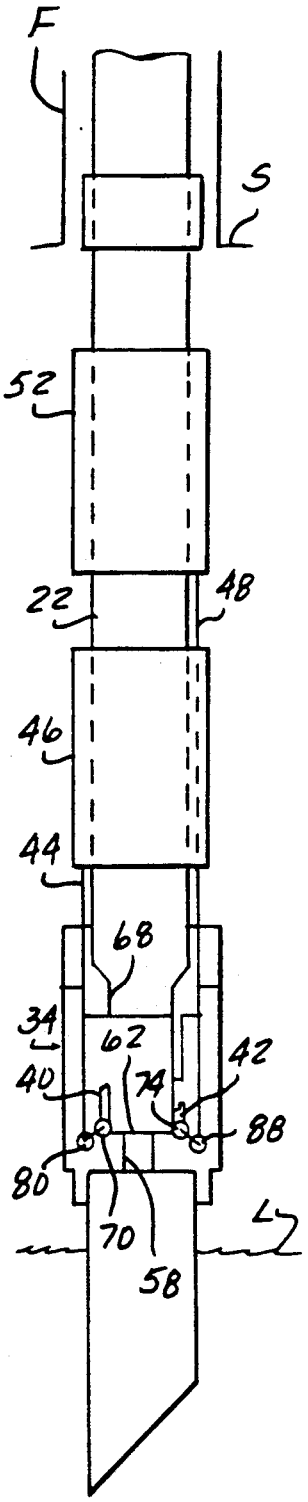
FIGS. 4, 5 and 6 are schematic diagrams of the assembly of FIG. 1 showing successive stages in the actuation of the valve.
Figure 5:
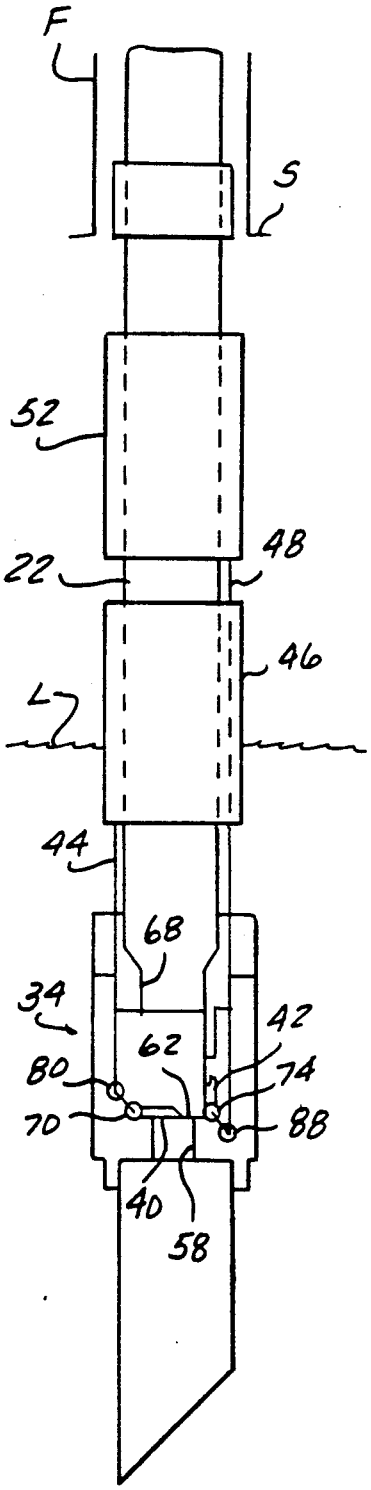
Figure 6:
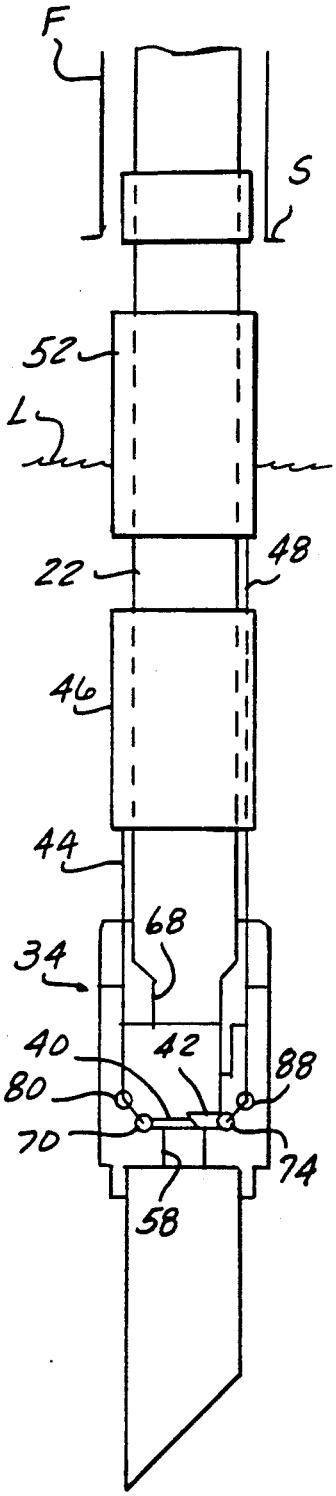

Operation of the valve flappers 40 and 42 is best seen from the schematic diagrams of FIGS. 4, 5 and 6. In FIG. 4, valve flappers 40 and 42 are shown in their valve open position which they would assume when the level of fuel L in tank S is below lower float 46. When in this position, the weight of floats 46 and 52 is such that the downward force exerted by the floats via their actuating rods 44, 48 is sufficient to pivot the valve flappers 40, 42 upwardly about their respective pivots 70, 74 to a substantially vertical position. When in this position, the flappers lie in the recess defined beneath flange 64 outwardly from the reduced diameter sections 68, 58 of the fuel flow passage, thus in the event fuel is flowing downwardly through drop tube 22, the main flow of fuel passes inwardly of the open flappers 40 and 42, and this downward flow does not normally attempt to urge the flappers to their closed position.

Assuming the tank is being filled with fuel, the level of fuel within the tank will rise from that shown in FIG. 4 to a higher level indicated in FIG. 5, and this rise of level will buoy up lower float 46. Upward movement of float 46 from the FIG. 4 to the FIG. 5 position will cause its actuating rod 44 to pull upwardly on pivot 80, this action swinging valve flapper 40 in a clockwise direction about its pivot 70 to move the flapper 40 into the path of downwardly flowing fuel which will promptly drive flapper 40 downwardly into sealing engagement with valve seat shoulder 62. In FIG. 5, the valve flapper 40 is shown in its closed position in which it partially, but not completely, blocks the upper end of reduced diameter flow passage 58 in the lower portion of valve housing 34. The portion of the cross sectional area of passage 58 blocked by the closed valve flapper 40 is chosen to be a major portion of the cross sectional flow area, preferably a percentage of the cross sectional flow area somewhere in the range of 75% to 90%.

With valve flapper 40 closed and valve flapper 42 still open as indicated in FIG. 5, the normal incoming flow of fuel through the valve will be reduced in proportion to the reduction of the cross sectional flow area achieved by the closure of flapper 40. As stated above, valve flapper 40 is forcibly closed by the flow of fuel through the valve assembly, a flow rate of the order of three to four hundred gallons per minute being typical, and this forcible closure with the subsequent substantial reduction in available flow area will generate a water hammer which will be observable by the delivery man. Triggering of the closure of valve flapper 40 by elevation of float 46 is typically chosen to occur when the level of fuel within the tank rises to a level of roughly 90% of full capacity of the tank.

Preferred practice would be to have the delivery man shut off the flow of fuel at the tank truck upon observing the water hammer effect generated by the closure of the flapper 40. If this is done, fuel in the tank truck supply hose downstream of the tank truck shutoff valve can easily drain into the storage tank through the valve opening present in the shutoff valve due to the fact that flapper 42 is still in its open position, and there is ample room in the tank to accommodate this fuel.

However, the delivery man normally wants to put as much fuel as he possibly can into the storage tank and may delay actuating the tank truck shutoff valve until the level of fuel within the tank rises to the level indicated in FIG. 6, at which time upper float 52 is buoyed upwardly by the fuel to a point where its elevating actuating rod 48 swings the second flapper 42 in a counterclockwise direction about its pivot 74 into the path of downwardly flowing fuel which drives flapper 42 to its closed position and, in so doing, completely blocks flow of fuel from drop tube 22 into the reduced diameter section 58 below valve seat 62. This closure traps fuel above the closed flappers 40, 42 throughout the interior of drop tube 22 and the tank truck supply hose. The only flow of fuel from drop tube 22 into the interior of storage tank S which can occur when both flappers 40 and 42 are closed is upwardly from the interior of valve housing 34 through the actuating rod bores 82, 84 and 90, 92 (FIG. 2). This passage is a relatively restricted passage and the pressure differential urging flow through these last bores is the difference between the static head of fuel in the drop tube and tank truck supply hose and the static head of fuel within storage tank S. Thus, in this latter situation, it is quite likely that upon disconnection of the tank truck hose coupling from adapter 24 at the upper end of the valve assembly, some fuel from the tank truck supply hose will be spilled. It is thus desirable to employ an overfill containment device, such as that shown in U.S. Pat. No. 4,793,387 at the upper end of the fill pipe.

Fuel trapped above the closed valve flappers 40 and 42 is eventually drained into storage tank S when the level of fuel within the tank is drawn down to a point where upper float 52 is no longer buoyed upwardly by the fuel and the moment exerted by the weight of float 52 upon valve flapper 42 exceeds the static head of fuel within the valve housing which holds flapper 42 in its closed position As the level of fuel within the tank drops, the level of fuel within drop tube 22 and flow passage 36 through the valve housing will correspondingly drop as fuel flows from the flow passage upwardly through the actuating rod bores in the housing so that the level of fuel within the drop tube and valve housing matches that in the storage tank. Opening of valve flapper 40 allows the remaining fuel within flow passage 36 to drain into the tank as its level drops, and eventually the unbuoyed weight of the lower float 46 will similarly swing flapper 40 back to its valve open position.

It will be noted that the outer diameter of valve housing 34 and floats 44 and 48 is less than the inner diameter of the storage tank fill pipe F so that the valve assembly of the present invention may be easily retrofitted into existing underground storage tanks.

In FIGS. 8–19, a slightly modified version of the two-stage valve described above is disclosed, the modifications to the previously described valve being for the purpose of utilizing a locking pin mechanism to positively prevent inadvertent premature closure of the valve flappers. In FIGS. 8-19, structure corresponding to that previously described is identified by the previously employed reference numerals.

FIGS. 8-14 disclose the locking mechanism employed in conjunction with the main valve flapper 40, a similar mechanism being employed in conjunction with the second flapper 42. Modifications from the previously described two-stage valve include the employment of stop collars fixedly clamped to the actuating rod above and below its associated float to accommodate a limited amount of vertical sliding movement of the actuating rod relative to its float. In the previously described embodiment, the actuating rod was directly coupled to its float and incapable of vertical movement relative to the float. A second modification involves the provision of a relatively short actuating link 98 (see FIG. 14) between the crank arm 78 of the valve flapper and the lower end of actuating rod 44 to accommodate horizontal displacement of the pivot 100 at the distal end of crank 78 as the flapper rotates about its pivot 80 during movement between its open and closed positions.

Figure 14:
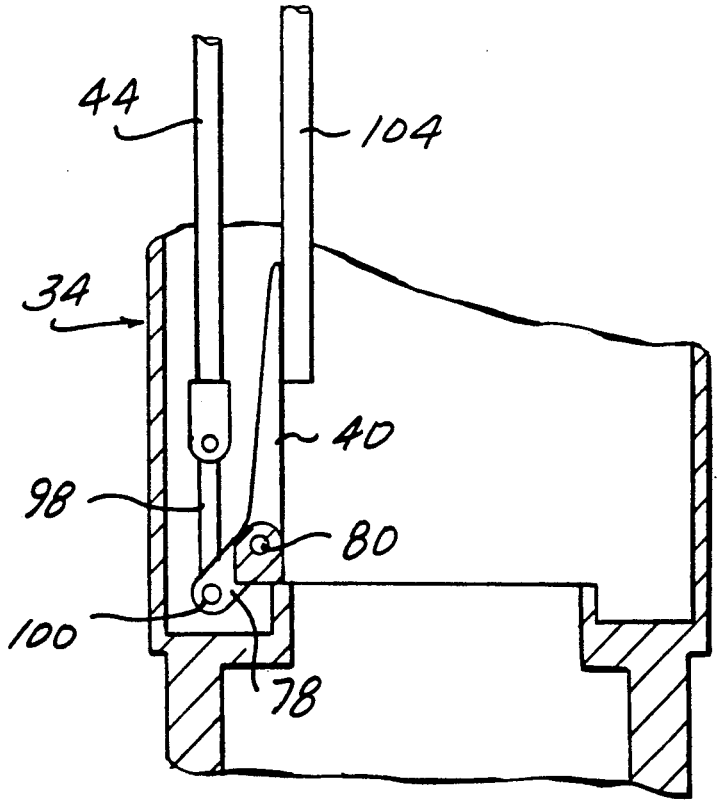
FIG. 14 is a detailed cross sectional view taken on the line 14—14 of FIG. 12.
Figure 12:
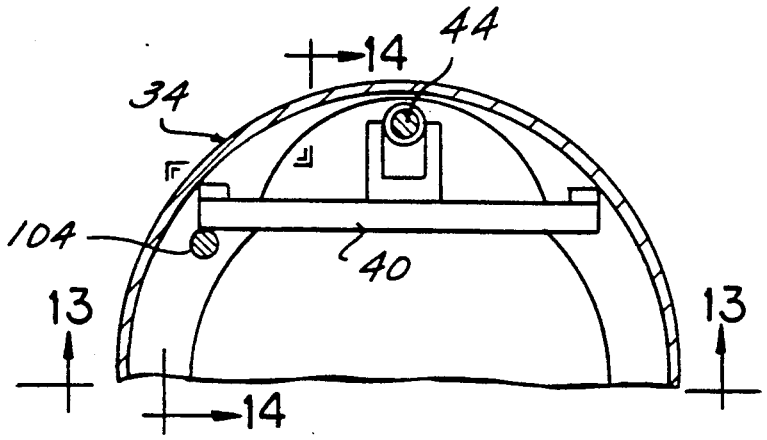
FIG. 12 is a partial cross sectional view taken at the location of line 3—3 of FIG. 2, showing the lower end of the locking rod of FIG. 8 in its locking position.
Figure 13:
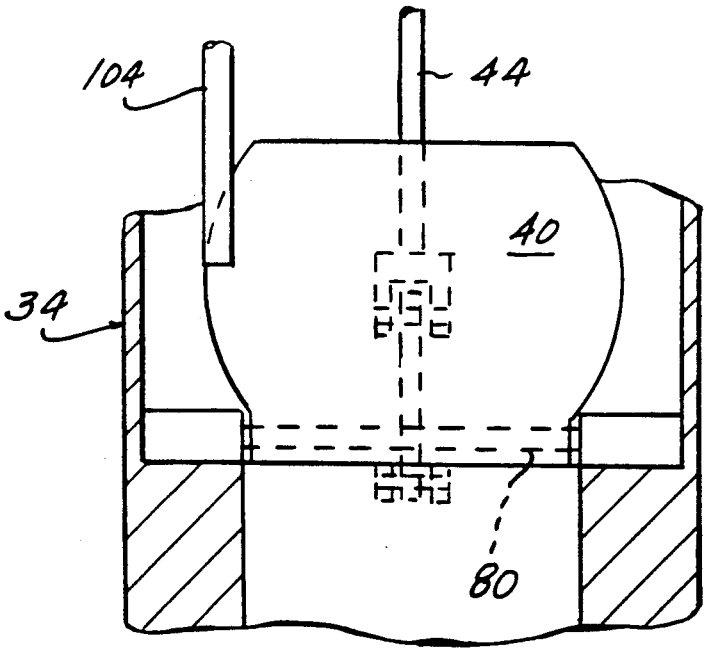
FIG. 13 is a detailed cross sectional view taken on the line 13—13 of FIG. 12.

Referring briefly to FIG. 2, when the flapper 40 is in its open position, illustrated in broken line in FIG. 2, the upper end of the flapper is located within a recess or enlarged diameter section 60 of the fuel flow passage beneath a shoulder 102, so that the flapper in this position is substantially shielded from the main stream of fuel flowing downwardly through the reduced diameter section of the passage above shoulder 102. However, this shielding is not complete in that fuel will flow into and fill recess 60 behind (to the left as viewed in FIG. 2) the elevated flapper 40 and, under certain flow conditions, may tend to shift the upper end of the elevated flapper outwardly to the right as viewed in FIG. 2 into the main flow stream. Should this occur, the downwardly flowing fuel will forcibly drive flapper 40 to the closed position. To prevent this inadvertent closure of the flapper, the valve assembly of FIGS. 8-19 includes an elongate rod or locking pin 104 whose lower end will project in front of the opened flapper 40 as best seen in FIGS. 12-14 to provide a positive stop thereby preventing movement of flapper 40 from its open position into the main stream of fuel flow.

Figure 8:
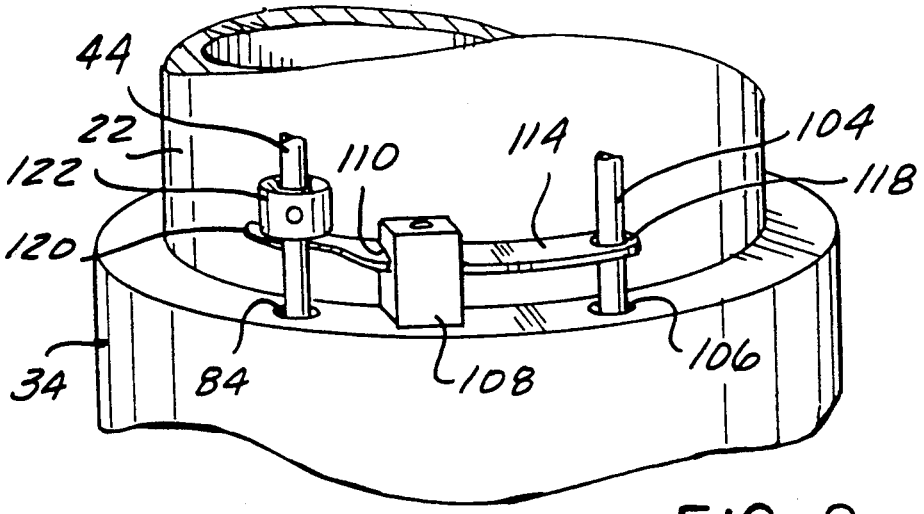
FIG. 8 is a perspective view of the upper portion of the valve housing of a modified valve assembly with certain parts broken away, showing portions of a locking pin device utilized to prevent inadvertent valve closure.
Figure 9:
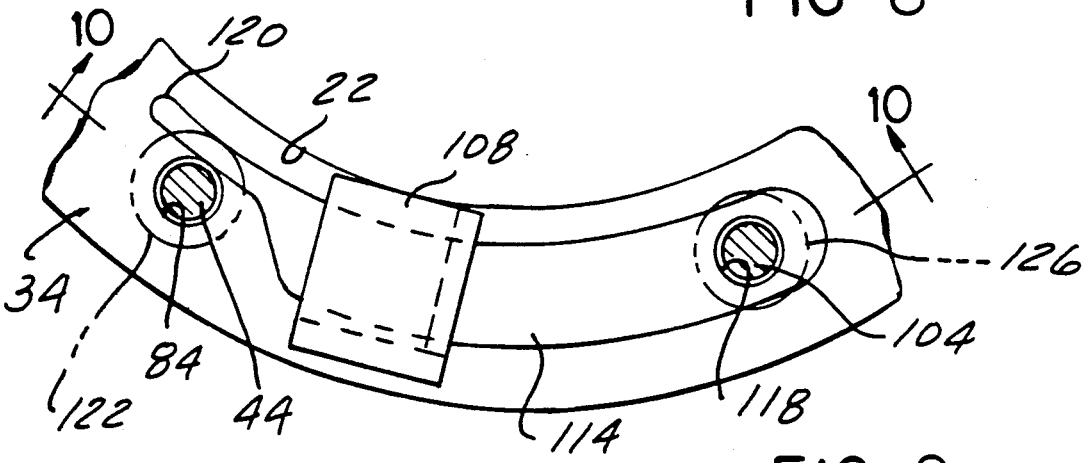
FIG. 9 is a partial top plan view, with certain parts shown in section, of the locking rod gripper mechanism shown in FIG. 8.
Figure 11:
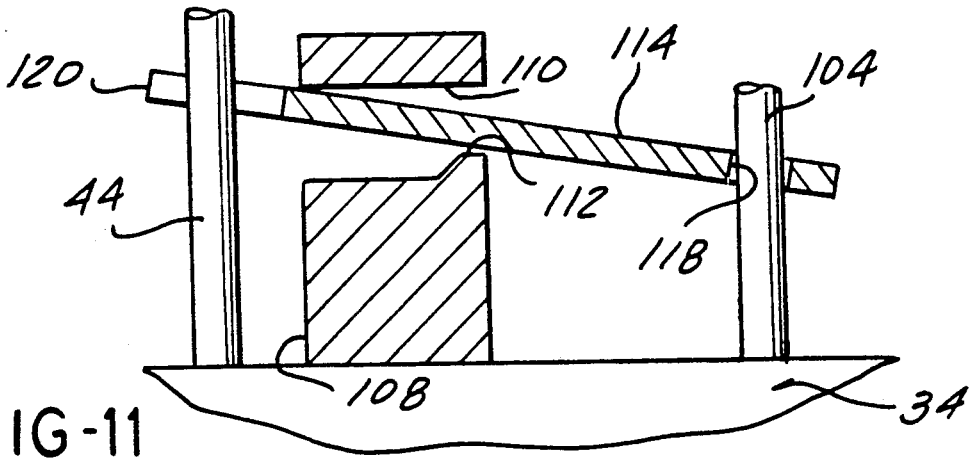
FIG. 11 is a detailed cross sectional view similar to FIG. 10, showing the gripper mechanism in its locking position.
Figure 10:
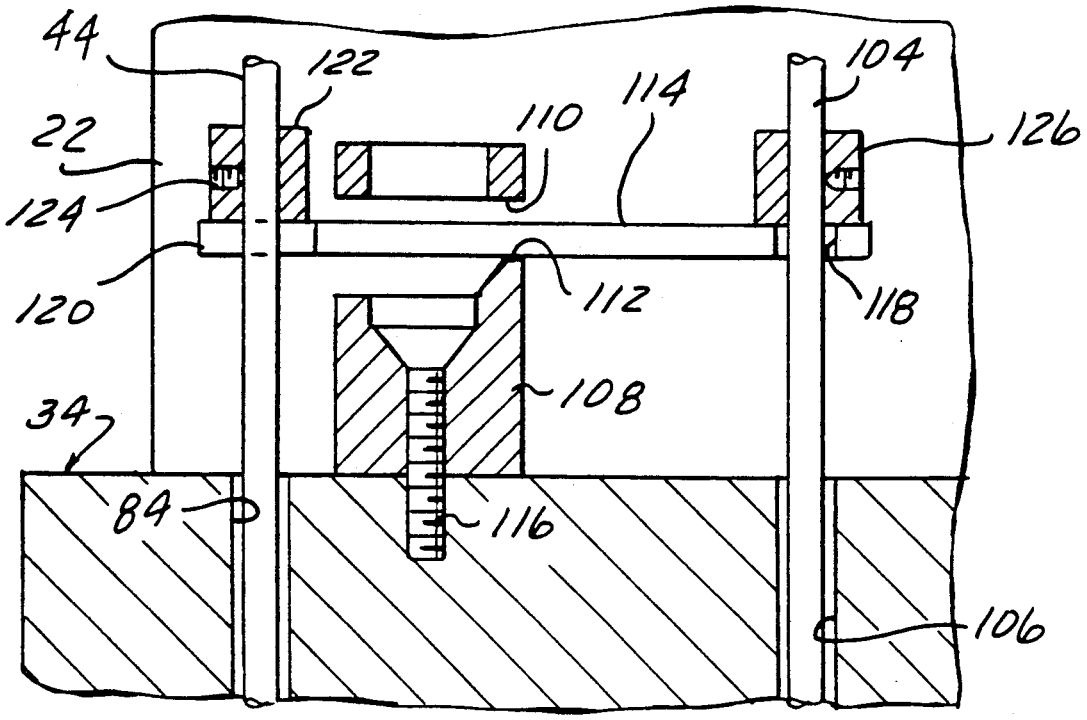
FIG. 10 is a detailed cross section view taken on the line 10—10 of FIG. 9 showing the gripper mechanism in its released position.

The locking portions of the locking device are best seen in FIGS. 8-11. Locking rod 104 projects upwardly from the interior of valve housing 34 freely through an enlarged bore 106 through the top of the housing. At the top of the housing, a hinge or fulcrum block 108 is fixedly mounted upon housing 34 at a location between the actuating rod 44 of flapper 40 and the locking pin 104 associated with flapper 40. Fulcrum block 108 is formed with a horizontal slot 110 in one side of the block, one side of this slot being formed, as best seen in FIGS. 10 and 11, with a relatively narrow elevated fulcrum ledge upon which an elongate plate-like gripper lever 114 rests, as best seen in FIGS. 10 and 11. As best seen in FIG. 10, fulcrum block 108 is fixedly secured to valve housing 34 as by a mounting screw 116.

Gripper lever 114 is formed adjacent one end with a bore 118 of an internal diameter somewhat greater than the outer diameter of locking pin 104. As best seen by a comparison of FIGS. 10 and 11, when gripper lever 114 is in a horizontal position as in FIG. 10, locking rod 104 can slide freely upwardly and downwardly through bore 118, however, if lever 114 is inclined from the horizontal as in FIG. 11, the edges of bore 118 at the top and bottom sides of lever 114 will bite into, and thus grip, rod 104 to prevent downward movement of rod 104 when lever 114 is positioned as in FIG. 11.

At the opposite end of gripper lever 114, an actuating finger 120 projects from the main body portion of lever 114 to pass freely between actuating rod 44 and the adjacent side of drop tube 22. As best seen in FIG. 9, in its longitudinal extent gripper lever 114 is curved in correspondence to the curved outer surfaces of drop tube 22 and housing 34.

In FIGS. 8 and 10, a stop collar 122 fixedly clamped to actuating rod 44 as by a set screw 124, is shown resting upon the top of actuating finger 122 of gripper lever 114 to position lever 114 in the horizontal position shown. Stop collar 122 is so located upon actuating rod 44 that it assumes the position shown in FIG. 10 relative to the fixed housing 34 when flapper 40 is in its open position. It should be noted that because of the direct mechanical coupling between flapper 40 and its actuating rod 44, the opened and closed positions of the flapper respectively define the lower and upper end limits of movement of rod 44 relative to the fixed portions of the valve assembly.

A second stop collar 126 fixed to locking pin 104 is shown in FIG. 10 resting on the top of gripper lever 114. Collar 126 is so located on locking pin 104 that when in the position shown in FIG. 10, the lower end of locking pin 104 is located in the locking position relative to flapper 40 shown in FIGS. 12-14.

Figures 15, 16, 17, 18, 19:
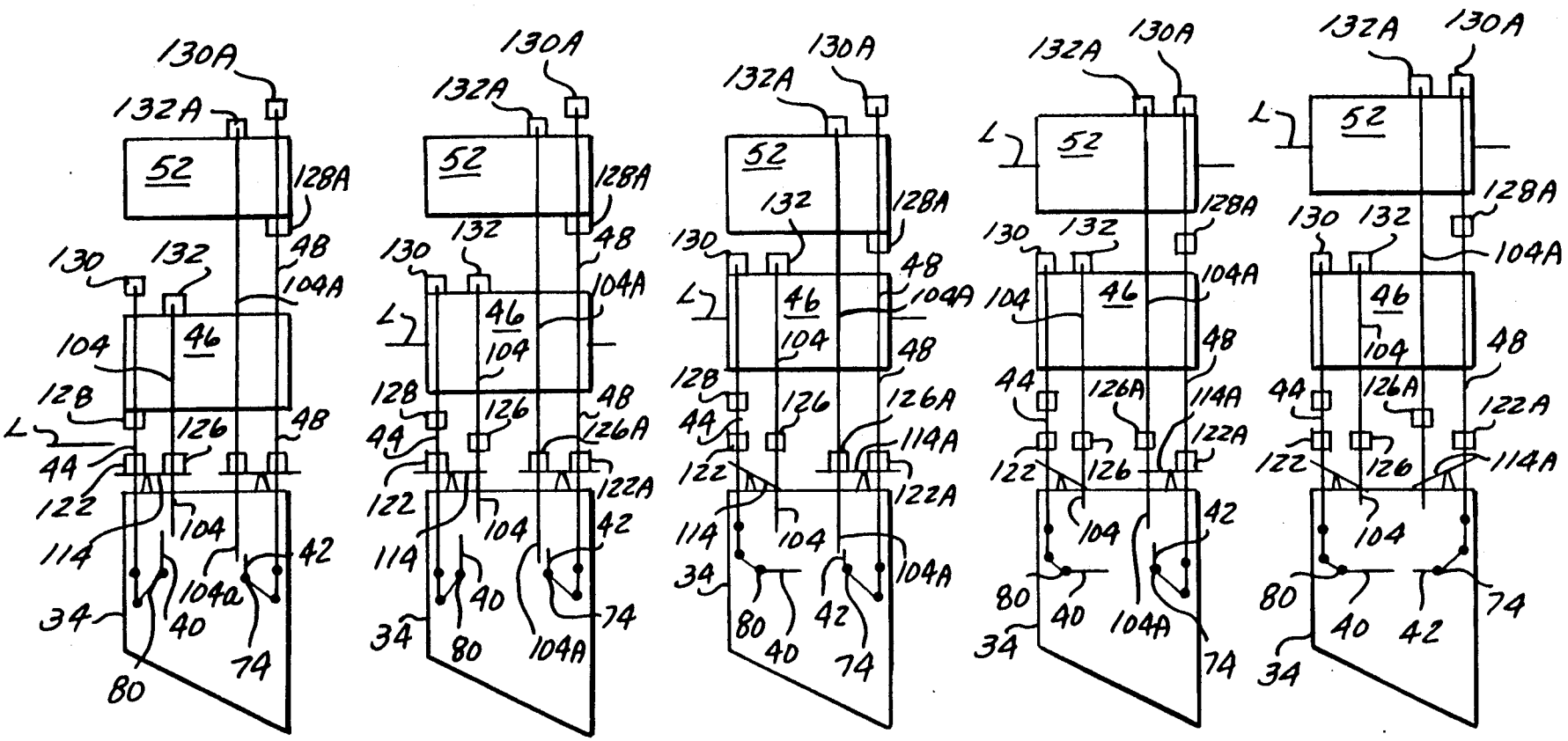
FIG. 15-19 are schematic diagrams showing successive stages of operation of the locking devices.

Operation of the locking device for flapper 40 described above is best seen from the schematic diagrams of FIGS. 15, 16 and 17.

In FIG. 15, flapper 40 is shown in its open position with the lower end of locking pin 104 projecting in front of the elevated valve flapper 40, this schematic representation of FIG. 15 corresponding to the more detailed showings of FIGS. 10 and 14. As in FIG. 10, with the flapper 40 opened and locking pin 104 in its locking position, the stop collars 122 and 126 on actuating rod 44 and locking pin 104 respectively rest upon the top of gripper lever 114 to locate the gripper lever in the horizontal position shown in FIG. 10 and indicated in FIG. 15.

In FIG. 15, it is assumed that the level of liquid L within the tank is below lower float 46 and the float is thus at its lowermost position relative to valve housing 34. At this time, the lower side of float 46 rests upon a second stop collar 128 fixed to actuating rod 44. A third stop collar 130 is fixed to the upper end of actuating rod 44, and with flapper 40 in the open position shown in FIG. 15, rod 44 is at its lowermost end limit of movement relative to housing 34, and at this time locates stop collar 130 at a location spaced above the top of float 46. A stop collar 132 fixed to the upper end of locking pin 104 rests, at this time, on the top of float 46, and with float 46 in its lowermost position, stop collar 132 locates the lower end of locking pin 104 in its locking position in front of the opened flapper 40.

Turning now to FIG. 16, as the level L of liquid in the tank rises, float 46 will eventually be buoyed up by the liquid and start to rise. As float 46 rises from the position shown in FIG. 15 to that shown in FIG. 16, the upwardly moving float lifts stop collar 132 and the attached locking pin 104 to draw the lower end of pin 104 upwardly clear of the opened flapper 40. In FIG. 16, float 46 has been moved upwardly from the position shown in FIG. 15 to a position in which the top of the float has just barely moved into contact with the upper stop collar 130 on actuating rod 44, but has not as yet lifted rod 44 from the position shown in FIG. 15, hence flapper 40 is still in its opened position as viewed in FIG. 16. Note that in FIG. 16, stop collar 126 on locking pin 104 has been moved upwardly clear of gripper lever 114, the horizontal position of lever 114 permitting rod 104 to slide freely through bore 118 in lever 114. The center of gravity of lever 114 as viewed in FIGS. 15 and 16 is to the right of the fulcrum, hence lever 114 remains horizontal because stop collar 122 prevents upward movement of the left-hand end of lever 114 as viewed in FIGS. 15 and 16.

In FIG. 17, the level of liquid L in the tank has risen to lift float 46 upwardly above the position shown in FIG. 16, this rising movement of float 46 lifting with it actuating rod 44 because of the engagement of stop collar 130 with the top of float 46. In addition to shifting flapper 40 to its closed position, this last elevation of float 46 causes rod 44 to lift stop collar 122 upwardly clear of gripper lever 114, and the lever will gravitationally pivot downwardly to the inclined position illustrated in FIG. 17, this inclined position corresponding to that illustrated in FIG. 11. As described above, the downwardly inclined position of gripper lever 114 causes the walls of its bore 118 (FIG. 11) to bite into locking pin 104 to prevent downward movement of the locking pin. Pin 104 can continue to move upwardly through the gripper lever, but downward movement will be prevented since clockwise pivotal movement of lever 114 is prevented by the engagement between the inclined lever and upper side of slot 110. Pin 104 is thus, in FIG. 17, locked against downward movement from a position in which its lower end is spaced well above the path of movement of flapper 40.

When the level of liquid L within the tank starts to drop below that indicated in FIG. 17, float 46 will start moving downwardly. Because locking pin 104 is locked, at this time, against downward movement by the inclined gripper lever 114, stop collar 132 will remain in the elevated position shown in FIG. 17, while stop collar 130 on actuating rod 44 will move downwardly with the float, the consequent downward movement of actuating rod 44 shifting flapper 40 from the closed position of FIG. 17 toward the opened position shown in FIG. 16. When float 46 has been lowered to the level of FIG. 16, stop collar 122 on rod 44 will have moved downwardly into contact with the left-hand end of gripper lever 114 and, when flapper 40 reaches its fully opened position shown in FIG. 16, stop collar 122 will have located lever 114 in the horizontal position shown in FIG. 16. With lever 114 back in its horizontal position, rod 104 is unlocked and can drop until its stop collar 132 again rests on float 46, as shown in FIG. 16. Further lowering of float 46 below the position shown in FIG. 16 will lower locking pin 104 until the float contacts stop collar 128 (FIG. 15), at which time stop collar 126 on locking pin 104 will rest upon the horizontal lever 114 to establish the fully lowered position of locking pin 104 in its locking position.

The locking arrangement described in detail above employed in conjunction with flapper 40 is duplicated with a similar locking mechanism employed in conjunction with flapper 42. The locking mechanism employed with flapper 42 is shown only schematically in FIGS. 15-19, reference numerals with the subscript A indicating portions of the flapper 42 locking mechanism corresponding to the correspondingly referenced parts of the flapper 40 locking mechanism. The actuating rod 48 and the locking pin 104A of the flapper 42 actuating and locking mechanism both pass freely upwardly through bores in the lower float 46 and also through vertical bores through upper float 52. Raising and lowering of lower float 46 has no influence on the operation of the flapper 42 locking mechanism, and raising and lowering of upper float 52 has no effect on the flapper 44 locking mechanism. FIGS. 17, 18 and 19 show stages in the operation of the flapper 42 locking mechanism which correspond to those stages of the flapper 40 locking mechanism operation respectively shown in FIGS. 15, 16 and 17.

While certain embodiments of the invention have been described in detail, it will be apparent to those skilled in the art the disclosed embodiments may be modified. Therefore, the foregoing description is to be considered exemplary rather than limiting, and the true scope of the invention is that defined in the following claims.

We claim:

1. An overfill valve assembly for preventing overfilling of a liquid storage tank via an inlet opening in the top of said tank, said valve assembly comprising a valve housing having a flow passage extending vertically therethrough, first valve means in said housing movable between a valve open position at one side of said flow passage and a valve closed position wherein said first valve means projects into said flow passage to substantially restrict downward flow through said passage, second valve means in said housing movable between a valve open position at the opposite side of said flow passage and a valve closed position wherein said second valve means is cooperable with said first valve means when both of said first and second valve means are in their respective valve closed positions to block all downward flow through said passage, a vertically elongate hollow drop tube sealingly secured to said valve housing and extending upwardly therefrom to an upper end, said drop tube being in fluid communication with and defining an upward extension of said flow passage, a first hollow tubular float slidably received upon the exterior of said drop tube above said housing, a second hollow tubular float slidably received upon the exterior of said drop tube above said first float, first link means coupling said first float to said first valve means to locate said first valve means in its valve open position when said first float is at a lower end limit of movement on said tube and to shift said first valve means toward its closed position in response to upward movement of said first float, second link means coupling said second valve means to said second float to locate said second valve means in its valve open position when said second float means is at a lower end limit of movement relative to said tube and to shift said second valve means toward its closed position in response to upward movement of said second float, means for fixedly and sealingly securing the upper end of said drop tube within said inlet opening in the top of said tank to accommodate filling of said tank with liquid via said flow passage with said drop tube projecting downwardly into the interior of said tank to locate said second float at a predetermined distance below the top of said tank.

2. The invention defined in claim 1 wherein said valve assembly is insertable into said tank from the exterior of said tank via said inlet opening.

3. The invention defined in claim 2 wherein said inlet opening is defined by a fill pipe projecting upwardly from the top of said tank, said fill pipe having an internal diameter greater than the largest horizontal dimension of said valve assembly, the upper end of said drop tube being mounted within the upper end of said fill pipe.

4. The invention defined in claim 1 wherein said housing includes means defining an upwardly facing valve seat having a central opening therethrough defining the upper end of a section of said flow passage of reduced cross sectional area, said first and second valve means including respective first and second valve flappers mounted in said housing for independent pivotal movement about respective first and second horizontal axes at opposite sides of said flow passage, said first and second flappers being sealingly engageable with portions of said valve seat when the respective valve means are in their valve closed position and projecting substantially vertically upwardly from their respective pivot axes at opposite sides of said flow passage when the respective valve means are in their valve open position.

5. The invention defined in claim 4 including means defining recesses in said housing at opposite sides of said flow passage for substantially shielding said flappers from downward flow of liquid through said flow passage when said flappers are in their valve open position.

6. The invention defined in claim 5 wherein said first valve flapper, when in its valve closed position blocks a major portion of said section of said flow passage of reduced cross sectional area.

7. The invention defined in claim 1 wherein said first link means comprises an elongate first rod coupled at its lower end to said first valve means and extending upwardly from said first valve means freely through a first bore in said housing to an upper end coupled to said first float.

8. The invention defined in claim 7 wherein said second link means comprises an elongate second rod coupled at its lower end to said second valve means and extending upwardly freely through a second bore in said housing and freely through a vertical bore through said first float to an upper end coupled to said second float.

9. The invention defined in claim 7 wherein said first valve means comprises means in said housing defining an upwardly facing valve seat extending around said flow passage, a first plate-like valve flapper mounted in said housing for pivotal movement about a horizontal first axis located at one side of said passage for pivotal movement between a valve open position wherein said first flapper projects upwardly from said first axis at one of said passage and a valve closed position wherein said first flapper lies against said valve seat, a first crank fixedly secured to said first flapper, and first pivot means coupling said first crank to the lower end of said first rod.

10. The invention defined in claim 9 wherein said first flapper when lying against said valve seat blocks a major portion of said flow passage and said second flapper when lying against said valve seat blocks the remaining minor portion of said flow passage.

11. The invention defined in claim 10 wherein said valve seat is spaced vertically downwardly upon the top of said housing and said first and second flappers, when both lying against said valve seat, support a column of liquid in said flow passage about said flappers, the unbuoyed weight of said second float being operable to shift said second flapper away from its seat against the weight of a column of liquid extending from said second flapper to the top of said valve housing.

12. A float actuated valve assembly for preventing overfilling of a liquid storage tank comprising an elongate hollow drop tube adapted to be mounted in a vertically extending position in the interior of said storage tank to conduct liquid into said tank a valve housing fixedly mounted at lower end of said tube, a float slidably received on said drop tube above said housing for upward and downward movement in response to a rise or fall of the level of liquid in said tank, valve means including a valve member mounted within said housing for pivotal movement between an elevated open position and a lowered closed position to control the flow of liquid from said drop tube into said tank, valve actuating means coupling said valve member to said float to locate said valve member in said open position when the level of liquid in said tank is at or below a selected first level and to locate said valve member in a closed position when the level of liquid in said tank is above a selected second level above said first level, a vertically elongate locking pin slidably received in a vertical bore in said housing and projecting upwardly from said housing to an upper end located above an upwardly facing surface on said float, first stop means fixed on said pin in overlying relationship to said surface on said float to raise said pin in response to a rise in the level of liquid in said tank and to lower said pin in response to a drop in the level of liquid in said tank, said locking pin projecting downwardly into a locking position in the path of movement of said valve member away from said open position when the level of liquid in said tank is below said first level and elevated to a position clear of said path when said level of liquid is at or above said first level, locking means operable in a first position to accommodate vertical movement of said pin in either direction and operable in a second position to which said locking means is biased to lock said pin against downward movement, and second stop means fixed to said actuating means for locating said locking means in said first position when the level of liquid in said tank is at or below said first level and for accommodating biased movement of said locking means to said second position in response to a rise in the level of liquid in said tank above said first level.

13. The invention defined in claim 12 wherein said locking means includes a gripper lever supported for pivotal movement about a horizontal axis upon a fulcrum fixed to said valve housing, said lever having a bore therethrough adjacent one end thereof loosely receiving said locking pin for free vertical movement through said bore when said lever is in a horizontal position constituting said first position of said locking means and for gripping said pin to prevent downward movement of said pin when said locking means is in said second position wherein said lever is in a pin gripping position inclined downwardly from said fulcrum toward said pin.

14. The invention defined in claim 13 wherein said second stop means comprises a stop member fixed to said actuating means engageable with the opposite end of said lever to locate said lever in said horizontal position when said valve member is in said open position, said lever being gravitationally biased toward said gripping position.

15. The invention defined in claim 14 further comprising a second stop element fixedly mounted on said pin between said float and said lever for engagement with said one end of said lever when said valve member is in said open position and said pin is in said locking position.

16. The invention defined in claim 12 wherein said valve actuating means comprises an actuating rod coupled at its lower end to said valve member and projecting vertically upwardly freely through a bore in said housing and a vertical bore through said float, a lower stop member fixed to said rod below said float and above said second stop means, an upper stop member fixed to said rod above said float, said lower stop member establishing a lower end limit of movement of said float when said valve member is in said open position and the level of liquid in said tank is below said float, said first stop means on said pin resting on said float to support said locking pin in said locking position when said float is at said lower end limit of movement.

17. The invention defined in claim 16 wherein said upper stop member is spaced above said float when said float is at said lower end limit by a distance at least equal to the distance said locking pin is elevated during movement from said locking position to said position clear of said path of movement of said valve member.

18. A float actuated overfill prevention device for preventing overfilling of a liquid storage tank via a drop tube projecting downwardly into the interior of said tank from the top of the tank, said device comprising a valve housing fixedly mounted on the lower end of said drop tube and having a vertical flow passage therethrough for discharging liquid from said drop tube into said tank at a level substantially below the top of said tank, a hollow cylindrical float received on the exterior of said drop tube above said valve housing for vertical sliding movement relative to said drop tube in response to variations in the level of liquid in said tank, shutoff valve means in said housing movable between an open position accommodating flow through said flow passage into said tank and a closed position restricting flow through said flow passage into said tank, said valve means comprising a flapper plate mounted in said housing for pivotal movement about a horizontal axis at one side of said passage between an elevated substantial vertical open position at one side of said passage and a lowered substantially horizontal closed position blocking at least a portion of said passage to establish a restriction to downward flow therethrough, actuating means including an elongate actuating rod coupled at its lower end to said flapper plate and projecting upwardly from said housing and a second vertical bore through said float to an upper end projecting above a first upwardly facing surface on said float, said first and second bores accommodating vertical sliding movement of said rod relative to said housing and said float, first stop means fixed to said rod at a location above said first upwardly facing surface for limiting upward movement of said float relative to said rod, second stop means fixed to said rod below said float for limiting downward movement of said float relative to said rod, said actuating means being operable upon upward movement of said float in response to a rise in the level of liquid in said tank above a first predetermined level to pivot said flapper plate from said open position to said closed position and to pivot said plate from said closed position to said open position upon downward movement of said float in response to a lowering of the level of liquid in said tank below said first predetermined level, an elongate rod like locking pin having a lower end located within said housing and projecting upwardly through a third vertical bore in said housing and a fourth vertical bore through said float to an upper end projecting above a second upwardly facing surface on said float, said third and fourth bores accommodating vertical sliding movement of said pin relative to said housing and said float, third stop means fixed to said pin above said second upwardly facing surface for limiting upward movement of said float relative to said pin to locate the lower end of said pin in a position blocking movement of said flapper plate from said open position when the level of liquid in said tank is at or below a second predetermined level lower than said first predetermined level and to lift said lower end of said pin upwardly to a position clear of said flapper plate upon a predetermined rise of said level of liquid above said second level, locking means operable upon closure of said flapper plate to lock said locking pin against movement downwardly relative to said housing and operable upon movements of said flapper plate to said open position for releasing said locking pin.

* * * * *